US008657632B2

(12) United States Patent
Liu et al.

(10) Patent No.: US 8,657,632 B2
(45) Date of Patent: Feb. 25, 2014

(54) I/O CONNECTOR

(75) Inventors: Bo Liu, Guang-Dong (CN); Rui-Bo Zhan, Guang-Dong (CN)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 158 days.

(21) Appl. No.: 13/314,152

(22) Filed: Dec. 7, 2011

(65) Prior Publication Data

US 2013/0149907 A1 Jun. 13, 2013

(51) Int. Cl.
*H01R 33/00* (2006.01)

(52) U.S. Cl.
USPC ..... 439/660

(58) Field of Classification Search
USPC ..... 439/353, 355–357, 607, 660
See application file for complete search history.

(56) References Cited

U.S. PATENT DOCUMENTS 5,340,329 A * 8/1994 Hirai ..... 439/357
5,533,908 A * 7/1996 Henry et al. ..... 439/329
6,030,249 A * 2/2000 Illg ..... 439/353
6,383,010 B1 * 5/2002 Mayo et al. ..... 439/357
7,670,174 B2 * 3/2010 Yuan et al. ..... 439/570
7,854,628 B2 * 12/2010 Chazottes et al. ..... 439/587
2004/0018772 A1 * 1/2004 Zhang et al. ..... 439/607
2005/0176306 A1 * 8/2005 Zhu et al. ..... 439/660
2006/0128219 A1 * 6/2006 Zhang et al. ..... 439/607
2008/0246045 A1 * 10/2008 Song ..... 257/98

* cited by examiner

*Primary Examiner* — Renee Luebke
*Assistant Examiner* — Larisa Tsukerman
(74) *Attorney, Agent, or Firm* — Cheng-Ju Chiang

(57) ABSTRACT

A connector includes an insulating housing having a rear wall of which a front side extends forward to form a tongue portion and a back side defines a concave groove in accordance with the tongue portion. The tongue portion defines a plurality of terminal grooves. A plurality of terminals each has a fixing portion fixed in a rear of the terminal groove with a rear end thereof further projecting into the concave groove, a contact portion disposed in the terminal groove, and a soldering tail stretching outside the insulating housing. A water-proof member is formed in the concave groove by injecting molten water-proof colloid in the concave groove to seal up intervals between the fixing portions of the terminals and inner sides of the rears of the terminal grooves. A metal shell is molded in the insulating housing.

7 Claims, 4 Drawing Sheets

I/O CONNECTOR

BACKGROUND OF THE INVENTION

1. Field of the Invention

The present invention relates to a connector, and more particularly to an I/O (Input/Output) connector.

2. The Related Art

A traditional I/O connector includes an insulating housing, a plurality of terminals assembled in the insulating housing respectively, and a shielding shell enclosing the insulating housing therein. The insulating housing has a top wall, a rear wall, a bottom wall and two side walls stood together to define a receiving space thereamong. A front side of the rear wall extends forward to form a tongue portion with a plurality of terminal grooves thereon. Each of the terminal grooves further penetrates rearward through the rear wall. The terminals are assembled in the terminal grooves with rear ends thereof projecting out of the terminal grooves and behind the rear wall. However, the shielding shell includes a first shielding shell and a second shielding shell which are attached together by laser welding. As a result, it is complicated to assemble the I/O connector. Furthermore, the water accidentally flowing into the receiving space may enter into an electronic product connected with the I/O connector from intervals between rears of the terminals and the terminal grooves opened in the rear wall.

SUMMARY OF THE INVENTION

Accordingly, an object of the present invention is to provide a connector. The connector includes an insulating housing which has a rear wall, a top wall, a bottom wall, and two side walls stood together to define a receiving space thereamong. A front side of the rear wall extends forward to form a tongue portion located in the receiving space. A back side of the rear wall defines a concave groove in accordance with the tongue portion. The tongue portion defines a plurality of terminal grooves communicating with the receiving space and each extending along a front-to-rear direction to penetrate through the rear wall to connect with the concave groove. A plurality of terminals each has a fixing portion fixed in a rear of the terminal groove of the insulating housing with a rear end thereof further projecting into the concave groove. A contact portion extends forward from a front end of the fixing portion, and is disposed in the terminal groove and further exposed to the receiving space. A soldering tail is formed from the rear end of the fixing portion and stretches outside the insulating housing. A water-proof member is formed in the concave groove of the insulating housing by injecting molten water-proof colloid in the concave groove to wrap around the rear ends of the fixing portions of the terminals and further seal up intervals between the fixing portions and inner sides of the rears of the terminal grooves. A metal shell is molded in the insulating housing.

As described above, it is easy to assemble the I/O connector by molding the metal shell in the insulating housing. Furthermore, the water-proof members formed in the concave groove and the rear ends of the receiving cavities can effectively prevent the water from accidentally flowing into the receiving space and entering into an electronic product connected with the I/O connector through the terminal grooves opened in the rear wall.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
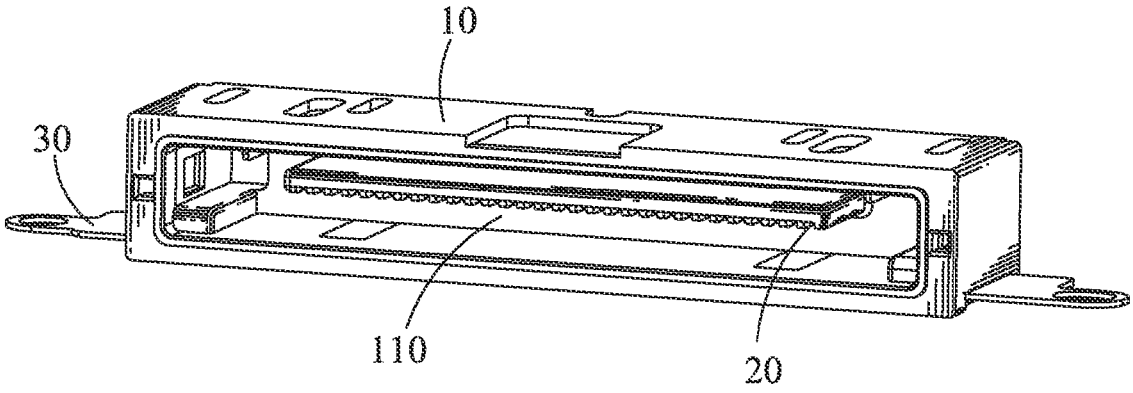
FIG. 1 is an assembled, perspective view of an I/O connector in accordance with an embodiment of the present invention.
Figure 3:
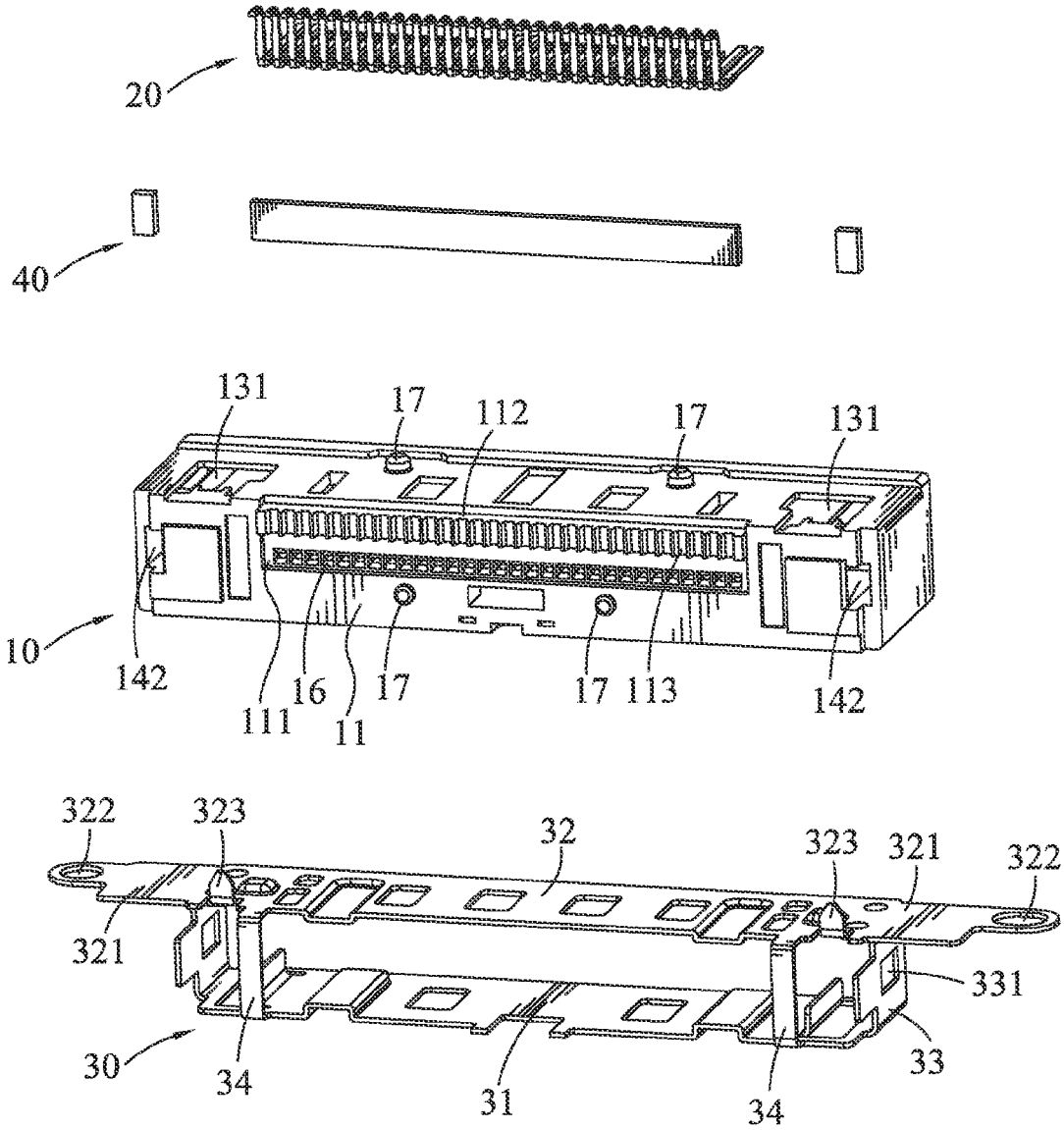
FIG. 3 is another angle of exploded perspective view of the I/O connector shown in FIG. 1.

Referring to FIG. 1 and FIG. 3, an I/O connector in accordance with an embodiment of the present invention includes an insulating housing 10, a plurality of terminals 20 and a metal shell 30.

Figure 2:
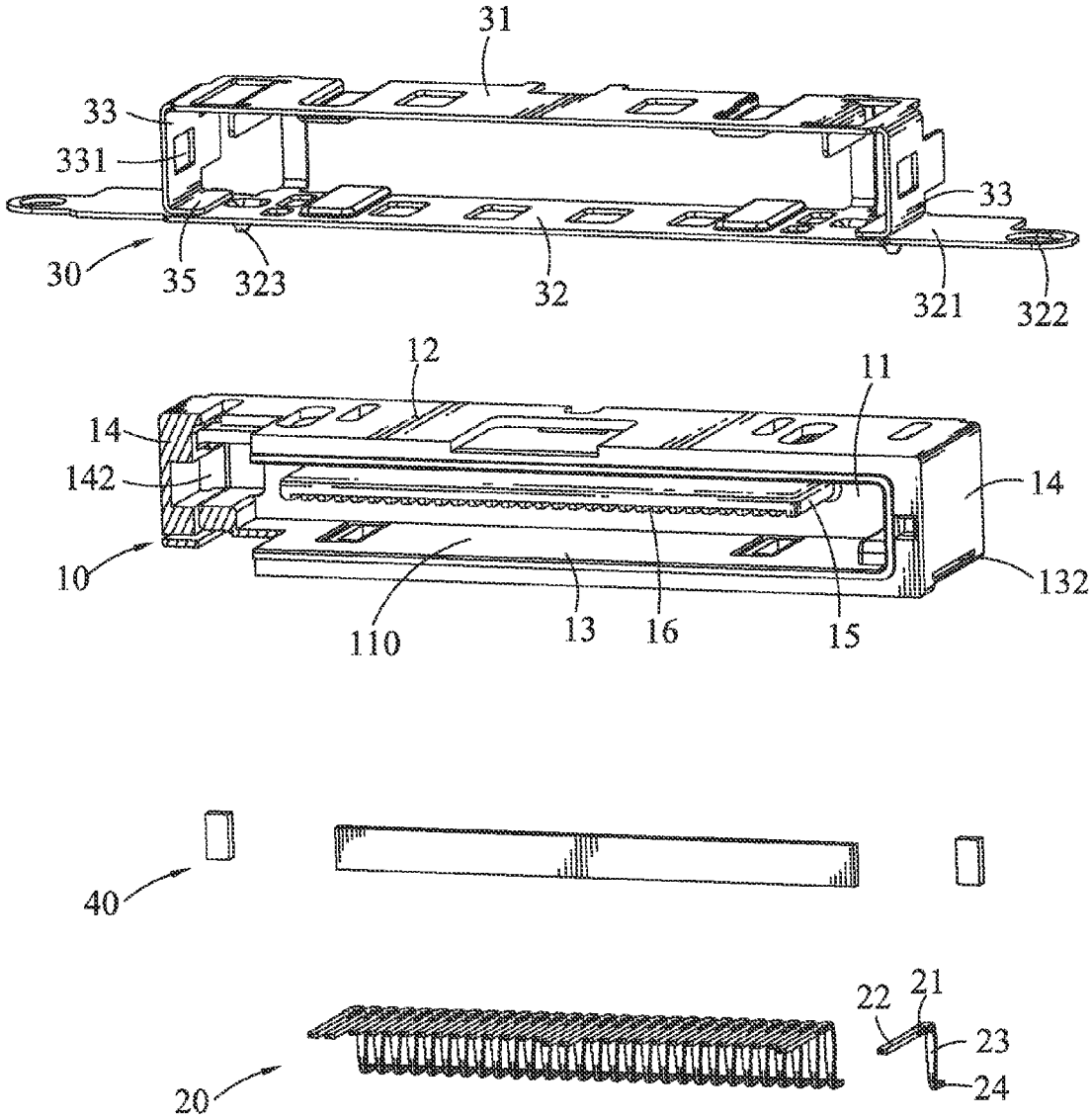
FIG. 2 is an exploded, perspective view of the I/O connector shown in FIG. 1.

With reference to FIGS. 2-3, the insulating housing 10 has a rear wall 11, a top wall 12, a bottom wall 13 and two side walls 14 stood together to define a receiving space 110 thereamong. A front side of the rear wall 11 extends forward to form a tongue portion 15 located in the receiving space 110. A back side of the rear wall 11 defines a concave groove 111 in accordance with the tongue portion 15. The tongue portion 15 defines a plurality of terminal grooves 16 communicating with the receiving space 110 and each extending along a front-to-rear direction to penetrate through the rear wall 11 to connect with the concave groove 111. The side wall 14 of the insulating housing 10 defines a receiving cavity 142 penetrating rearward through a back side of the side wall 14 and connecting with one side of the receiving space 110. A located block 112 is formed in the concave groove 111 of the insulating housing 10 and extends transversely under the terminal grooves 16. The located block 112 defines a plurality of locating fillisters 113 each aligned vertically with a rear end of the terminal groove 16. A bottom of the side wall 14 of the insulating housing 10 defines an inserting slot 132 horizontally penetrating through a side face of the side wall 14. Two ends of a bottom side of the bottom wall 13 define an opening 131 respectively. The back side of the rear wall 11 and the bottom side of the bottom wall 13 protrude outward to form a plurality of holding pillars 17.

Figure 4:
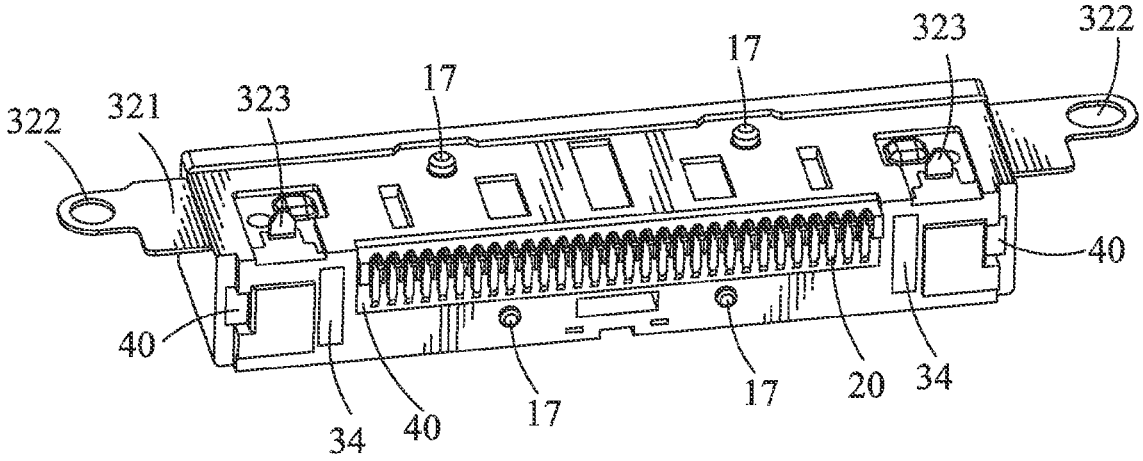
FIG. 4 is another angle of assembled perspective view of the I/O connector shown in FIG. 1.

Referring to FIG. 1, FIG. 2 and FIG. 4, a plurality of terminals 20 each has a fixing portion 21 fixed in a rear of the terminal groove 16 of the insulating housing 10 with a rear end thereof further projecting into the concave groove 111. A front end of the fixing portion 21 extends forward to form a contact portion 22 disposed in the terminal groove 16 and further exposed to the receiving space 110. A soldering tail 24 is formed from the rear end of the fixing portion 21 and stretches outside the insulating housing 10. The terminal 20 further has a locating arm 23 extending downward from the rear end of the fixing portion 21 and located in the corresponding locating fillister 113. The soldering tail 24 bends outward from a bottom end of the locating arm 23.

Referring to FIGS. 1-4, the metal shell 30 is molded in the insulating housing 10. The metal shell 30 has a top plate 31 molded in the top wall 12, a bottom plate 32 parallel to the top plate 31 and molded in the bottom wall 13, and two side plates 33 extending downward from two opposite side edges of the top plate 31 and molded in the side walls 14 between the receiving space 110 and the receiving cavities 142. Each side plate 33 defines a holding hole 331 connecting the corresponding receiving cavity 142 with the receiving space 110. A pair of soldering plates 35 bends inward from bottom ends of the side plates 33 and is laser welded on the bottom plate 32. The bottom plate 32 is connected with the top plate 31 by a pair of connecting strips 34 molded in back sides of the side walls 14 respectively. Two opposite ends of the bottom plate 32 of the metal shell 30 extend outward to form a pair of fastening plates 321 passing through the inserting slots 132 to stretch outside the side walls 14. A fixing hole 322 is opened in each fastening plate 321 of the metal shell 30. Two fixing feet 323 protrude downward from two ends of a rear edge of the bottom plate 32 and pass through the openings 131 of the insulating housing 10 to project under the bottom wall 13.

Referring to FIGS. 2-4, the I/O connector further includes a plurality of water-proof members 40. One of the water-proof members 40 is formed in the concave groove 111 of the insulating housing 10 by injecting molten water-proof colloid in the concave groove 111 to wrap around the rear ends of the fixing portions 21 of the terminals 20 and further seal up intervals between the fixing portions 21 and inner sides of the rears of the terminal grooves 16. A rear end of each receiving cavity 142 is blocked off by another water-proof member 40 formed by injecting molten water-proof colloid in the rear end of the receiving cavity 142.

As described above, it is easy to assemble the I/O connector by molding the metal shell 30 in the insulating housing 10. Furthermore, the water-proof members 40 formed in the concave groove 111 and the rear ends of the receiving cavities 142 can effectively prevent the water from accidentally flowing into the receiving space 110 and entering into an electronic product (not shown) connected with the I/O connector through the receiving cavities 142 and the terminal grooves 16 opened in the rear wall 11.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A connector, comprising:

an insulating housing having a rear wall, a top wall, a bottom wall and two side walls stood together to define a receiving space thereamong, a front side of the rear wall extending forward to form a tongue portion located in the receiving space, a back side of the rear wall defining a concave groove in accordance with the tongue portion, the tongue portion defining a plurality of terminal grooves communicating with the receiving space and each extending along a front-to-rear direction to penetrate through the rear wall to connect with the concave groove;

a plurality of terminals each having a fixing portion fixed in a rear of the terminal groove of the insulating housing with a rear end thereof further projecting into the concave groove, a contact portion extending forward from a front end of the fixing portion to be disposed in the terminal groove and further exposed to the receiving space, a soldering tail being formed from the rear end of the fixing portion and stretching outside the insulating housing;

a water-proof member formed in the concave groove of the insulating housing by injecting molten water-proof colloid in the concave groove to wrap around the rear ends of the fixing portions of the terminals and further seal up intervals between the fixing portions and inner sides of the rears of the terminal grooves; and a metal shell molded in the insulating housing;

wherein the side wall of the insulating housing defines a receiving cavity penetrating rearward through a back side of the side wall and connecting with one side of the receiving space, the metal shell has two side plates molded in the side walls of the insulating housing between the receiving space and the receiving cavities, each side plate defines a holding hole connecting the corresponding receiving cavity with the receiving space, a rear end of each receiving cavity is blocked off by another water-proof member formed by injecting molten water-proof colloid in the rear end of the receiving cavity.

2. The connector as claimed in claim 1, wherein a located block is formed in the concave groove of the insulating housing and extends transversely under the terminal grooves, the located block defines a plurality of locating fillisters each aligned vertically with a rear end of the terminal groove, the terminal further has a locating arm extending downward from the rear end of the fixing portion and located in the corresponding locating fillister, the soldering tail bends outward from a bottom end of the locating arm.

3. The connector as claimed in claim 1, wherein the back side of the rear wall and a bottom side of the bottom wall protrude outward to form a plurality of holding pillars.

4. A connector, comprising:

an insulating housing having a rear wall, a top wall, a bottom wall and two side walls stood together to define a receiving space thereamong, a front side of the rear wall extending forward to form a tongue portion located in the receiving space, a back side of the rear wall defining a concave groove in accordance with the tongue portion, the tongue portion defining a plurality of terminal grooves communicating with the receiving space and each extending along a front-to-rear direction to penetrate through the rear wall to connect with the concave groove;

a plurality of terminals each having a fixing portion fixed in a rear of the terminal groove of the insulating housing with a rear end thereof further projecting into the concave groove, a contact portion extending forward from a front end of the fixing portion to be disposed in the terminal groove and further exposed to the receiving space, a soldering tail being formed from the rear end of the fixing portion and stretching outside the insulating housing;

a water-proof member formed in the concave groove of the insulating housing by injecting molten water-proof colloid in the concave groove to wrap around the rear ends of the fixing portions of the terminals and further seal up intervals between the fixing portions and inner sides of the rears of the terminal grooves; and a metal shell molded in the insulating housing;

wherein the metal shell has a top plate molded in the top wall, a bottom plate parallel to the top plate and molded in the bottom wall, two side plates extending downward from two opposite side edges of the top plate and molded in the side walls, and a pair of soldering plates bending inward from bottom ends of the side plates and laser welded on the bottom plate, the bottom plate is connected with the top plate by a pair of connecting strips molded in back sides of the side walls respectively.

5. The connector as claimed in claim 4, wherein a bottom of the side wall of the insulating housing defines an inserting slot horizontally penetrating through a side face of the side wall, two opposite ends of the bottom plate of the metal shell extend outward to form a pair of fastening plates passing through the inserting slots to stretch outside the side walls.

6. The connector as claimed in claim 5, wherein a fixing hole is opened in each fastening plate of the metal shell.

7. The connector as claimed in claim 4, wherein two ends of a bottom side of the bottom wall define an opening respectively, two fixing feet protrude downward from two ends of a rear edge of the bottom plate and pass through the openings of the insulating housing to project under the bottom wall.

* * * * *